United States Patent [19]

Mustacchi et al.

[11] 4,403,028

[45] Sep. 6, 1983

[54] LIGHT SENSITIVE DIAZONIUM SALTS AND DIAZOTYPE MATERIALS

[75] Inventors: Henry Mustacchi, Port Washington, N.Y.; Arthur Gusmano, Wanaque, N.J.; Peter Muller, Port Washington, N.Y.

[73] Assignee: Andrews Paper & Chemical Co., Inc., Port Washington, N.Y.

[21] Appl. No.: 408,177

[22] Filed: Aug. 11, 1982

Related U.S. Application Data

[63] Continuation-in-part of Ser. No. 228,084, Jan. 26, 1981, abandoned.

[51] Int. Cl.[3] ..... G03C 1/54; G03C 1/60; G07C 113/04

[52] U.S. Cl. ..... 430/178; 430/157; 430/163; 430/171; 430/177; 430/179; 260/141; 260/142

[58] Field of Search ..... 430/147, 163, 164, 177, 430/188, 171, 179, 178, 157; 260/141 R, 141 S, 142, 141 AN

[56] References Cited

U.S. PATENT DOCUMENTS

| | | | |
|---|---|---|---|
| 1,973,148 | 9/1934 | Kemmerich | 430/171 |
| 2,022,923 | 12/1935 | Ossenbeck et al. | 260/141 AN |
| 2,237,885 | 4/1941 | Markush | 260/142 |
| 2,354,088 | 11/1944 | Reichel | 430/171 |
| 2,416,773 | 3/1947 | Reichel | 430/177 |
| 2,429,249 | 10/1947 | Von Glahn | 430/188 |
| 2,496,240 | 1/1950 | Von Glahn et al. | 430/171 |
| 2,612,494 | 9/1952 | Von Glahn et al. | 260/142 |
| 2,694,009 | 11/1954 | Sus | 430/188 |
| 3,219,447 | 11/1965 | Neugebauer et al. | 430/163 |
| 3,479,183 | 11/1969 | Habib et al. | 430/188 |
| 3,679,419 | 7/1972 | Gillich | 260/142 |
| 3,790,556 | 2/1974 | Doggett | 430/188 |

OTHER PUBLICATIONS

Dinaburg, M. S., "Photosensitive Diazo Compounds", Focal Press, 1964, pp. 91–94.

Chemical Abstracts, vol. 34, #5831, 1940.

*Primary Examiner*—Charles L. Bowers, Jr.

*Attorney, Agent, or Firm*—Kane, Dalsimer, Kane, Sullivan & Kurucz

[57] ABSTRACT

Disclosure is made of a class of diazonium salts characterized in part by their improved thermal stability and non-flammability. The salts are useful in diazotypy.

16 Claims, No Drawings

LIGHT SENSITIVE DIAZONIUM SALTS AND DIAZOTYPE MATERIALS

CROSS-REFERENCE TO RELATED APPLICATION

This application is a continuation-in-part of our copending application Ser. No. 228,084 filed Jan. 26, 1981, abandoned.

BACKGROUND OF THE INVENTION

1. Field of the Invention

The invention relates to diazonium salt compounds and their use in diazotypy.

2. Brief Description of the Prior Art

The diazotype reproduction process is well-known to the art and is described in great detail in "Light Sensitive Systems" by Jaromir Kosar, John Wiley & Conc, Inc., New York 1962, and in "Reproduction Coating" by E. Jahoda, 4th Edition Andrews Paper & Chemical Co., Inc., Port Washington, N.Y.

In general, diazotype reproduction prints are obtained by an imagewise exposure of a light-sensitive diazo material to ultraviolet light followed by development of the exposed diazotype material. There are several different methods available to develop the latent image imposed on the light-sensitive diazo material by the light exposure including ammonia development, amine development, thermal development and moist (liquid) development.

The light-sensitive diazo material generally comprises a light-sensitive diazo composition affixed to a support base such as paper or film such as polyethylene terephthalate film, cellulose acetate, or a polymeric resin coated, like base support. The light-sensitive diazo composition may comprise a light-sensitive diazonium salt compound in admixture with diazo enhancing compounds. Upon exposure of the light-sensitive diazonium compound to ultraviolet light through a translucent original having opaque image portions, the unmasked portion of the diazonium salt are decomposed by the ultraviolet radiation whereas the masked portions are left undecomposed. The latent image created by the image-wise exposure may then be developed by the methods described above.

In the so-called "dry development" process, the light-sensitive diazo composition will have contained, in addition to the light-sensitive diazonium salt, an azo coupling agent or color former and an acidic coupling inhibitor. Development of the latent azo dye image is accomplished by placing the exposed diazo material in an alkaline atmosphere which neutralizes the acidic inhibitor, allowing the undecomposed diazonium salt and coupler to react. The latent image is thereby developed.

In the moist development process (also called the one-component process) the light sensitizing diazo composition contains essentially the diazonium salt compound. After image-wise exposure, development of the latent azo dye image is accomplished by applying to the light-exposed diazo material a buffered solution containing the azo coupling agent (which then reacts with the undecomposed diazonium salt to develop the latent image).

The prior art diazonium compounds employed in preparing light-sensitive diazo materials are generally used in the form of their acidic salts such as the zinc chloride, cadmium chloride, stannic chloride, sulfate and borofluoride salts. The acid salt derivatives are generally more stable than the parent diazonium compounds, which will often decompose spontaneously under ambient conditions.

For the preparation of diazo sensitized paper materials, the diazonium compound and ancilliary chemicals are dissolved in water and the resulting diazo composition is applied from the aqueous media to the base paper. It is, therefore, necessary for the diazonium salt to be substantially soluble in water. From a practical point of view, this requirement restricts the choice to a very few kinds of diazonium salts and in particular to the zinc chloride or the sulfate salts of the diazonium compound. Sulfate salts of diazonium are extremely soluble in water (and as a consequence are very difficult to isolate in solid form). Zinc chloride salts have a more limited solubility in water and are easy to isolate in solid form. However, in spite of the stabilizing effect of the zinc chloride, most diazonium chlorozincates are unstable when subjected to moderate heat. In addition such salts can be readily ignited and once ignited many burn vigorously with the emission of profuse toxic fumes and vapors.

For the preparation of diazo materials such as polymeric films and polymeric resin coated papers bearing diazo compositions, the diazonium and other ingredients are dissolved in polaric organic solvents such as alcohols, ketones or glycol ethers. The diazo composition is then applied from the solvent media to the base support material. It is therefore necessary for the diazonium salt to be soluble in such solvents. Borofluoride salts of diazoniums are generally soluble in organic solvents but most of them are, like the chlorozincates, unstable when subjected to moderate heat. They can also be readily ignited and when ignited burn vigorously with the emission of toxic fumes and vapors.

Because of the aforementioned serious hazards, special precautions and measures must be taken when handling or transporting the prior art diazonium salt compounds and diazo compositions. The Code of Federal Registrations, 49, Transportation, of Dec. 31, 1976 requires that any solid material which under conditions normally incident to transportation is liable to cause fire through friction, retained heat from manufacturing or processing or which can be ignited readily and when ignited burns so vigorously and persistently as to create a serious transportation hazard, be labelled "Flammable Solid" and be subjected to all the rules and regulations appertaining to the transportation of hazardous materials. In the case of international transportation, severe restrictions are imposed by the International Air Transport Association (IATA) for the air shipment of flammable solids, and by the Intergovernmental Maritime Consultive Organization (IMCO) for the ocean shipment of flammable solids. For instance, the IATA regulations requires a flammable solid to be packed in separate suitable containers of no more than 500 grams each with a total of no more than 12 kilograms. The IMCO regulations require that a flammable solid be stowed on the deck of a cargo ship, in a specially allocated area.

All the above mentioned regulations make the shipment and handling of prior art diazonium compositions not only more difficult, but also considerably more expensive than compounds which do not fall in a hazardous category.

In addition to the flammability hazards associated with diazonium chlorozincate salts, their relatively low thermal stability gives them a limited shelf life. Commercial diazonium chlorozincate salts tend to decompose slowly with time, even at room temperature, and in so doing lose part of their basic functional properties. In extreme cases of poor storage condition, for instance when a diazonium salt is exposed to tropical climate conditions, the decomposition can be so advanced as to make the diazonium totally unusable. For this reason it has often been necessary to keep diazonium compounds and compositions in refrigerated areas. This adds substantially to the cost of storage and imposes severe restrictions on inventory levels.

It has been suggested in order to decrease the hazard associated with unstable diazoniums to mix them with solid diluents or stabilizers such as tartaric acid, citric acid, aluminum sulfate, boric acid and other organic or inorganic salts. However, to obtain a sufficient reduction of the hazard, often up to 50% of diluents are required. Such a procedure reduces the rate of propagation of the flame, when the diazonium is ignited, but does not alter the flammability of the diazonium salt or its rate of thermal decomposition (which is inherent to the particular diazonium salt).

The diazonium salts of the present invention obviate many of the problems associated with the prior art diazonium compounds. The diazonium salts of the present invention exhibit a greater degree of thermal stability, non-inflammability and shelf-life. These improved characteristics are also found in diazotype materials prepared from the diazonium salts of the invention.

Other advantages of the compounds, compositions and diazotype reproducing materials of the invention will be described more fully hereinafter.

SUMMARY OF THE INVENTION

The invention comprises light-sensitive diazonium salts of the formula:

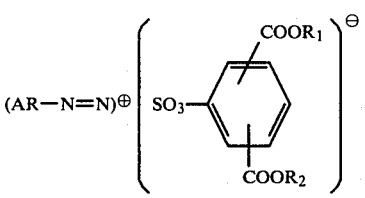

(I)

Where Ar represents aryl or substituted aryl; $R_1$ and $R_2$ are each selected from the group consisting of hydrogen and alkyl.

Preferred compounds of the formula (I) given above are those of more or less pronounced yellow color and which absorb ultraviolet light to undergo a photolytic decomposition to colorless products.

The term "light-sensitive" as used herein means the compound or material undergoes photolytic decomposition.

The term "Alkyl" is used throughout the specification and claims as meaning the monovalent moiety obtained by removal of a hydrogen atom from a parent alkane, which latter for example, contains 1 to 12 carbon atoms. Illustrative of such moieties are alkyl of 1 to 12 carbon atoms, inclusive, such as methyl, ethyl, propyl, butyl, pentyl, hexyl, heptyl, octyl, nonyl, decyl, undecyl, dodecyl and isomeric forms thereof.

The term "substituted aryl" as used herein means aryl as defined above wherein one or more hydrogen atoms have been replaced with one or more inert groups, i.e.; a group which will not interfere with the desired function of the compound of formula (I) as a light-sensitive ingredient of a diazotype composition. Representative of such inert groups are amino, alkylamino, alkylcycloalkylamino, cycloalkylamino, halogen, hydrocarbyl, aryloxy, alkoxy, alkylthio, arylthio, tolylthio, morpholino, pyrrolidinyl, piperidino, piperazino, halo-substituted hydrocarbyl and like groups.

In those compounds of the formula (I) where Ar represents a substituted aryl, there is a preference that the inert group substituent be selected from the group consisting of amino, alkylamino, dialkylamino, alkylhydroxyalkylamino, dihydroxyalkylamino, alkoxy, phenoxy, cycloalkylamino, alkylcycloalkylamino, alkylarylamino, alkylaralkylamino, diarylamino, tolylthio, morpholino, pyrrolidino, piperidino and piperizino. Most preferably these preferred inert substituent groups are located in the position para to the diazonium moiety. Of the latter preferred compounds (I), it is further preferred that the moiety Ar be unsubstituted in the positions ortho and meta to the diazonium moiety or substituted in one or both of these positions with a group selected from alkyl, alkoxy, phenoxy, halophenoxy, halogen and those of the formula $A_c$—NH— wherein $A_c$ represents carboxacyl.

The term "aryloxy" as used herein means the monovalent moiety of formula:

aryl—O— wherein aryl is as before defined. Illustrative of aryloxy are phenoxy, naphthoxy and the like.

The term "alkoxy" is used herein to mean the monovalent moiety of the formula:

—O—alkyl wherein alkyl is as described above. Illustrative of alkoxy are methoxy, ethoxy, butoxy, pentyloxy, heptyloxy, decyloxy, dodecyloxy and the like.

The term "alkylamino" as used herein means an amino group wherein one hydrogen has been replaced with an alkyl group as defined above.

The term "dialkylamino" as used herein means an amino group wherein two hydrogen atoms have been replaced with alkyl groups as defined above.

The term "alkylhydroxyalkylamino" means an amino group wherein one hydrogen atom has been replaced with an alkyl group and one hydrogen atom has been replaced with a hydroxyl-substituted alkyl group.

The term "dihydroxyalkyl amino" means an amino group wherein both hydrogen atoms have been replaced with hydroxy-substituted alkyl groups.

The term "alkylarylamino" is used to mean an amino group wherein one hydrogen atom has been replaced with an alkyl group and the other hydrogen atom has been replaced with an aryl group.

The term "diarylamino" means an amino group where each hydrogen atom has been replaced with an aryl group.

The term "alkylaralkylamino" means an amino group where one hydrogen atom has been replaced with an alkyl group and the other hydrogen atom has been replaced with an aralkyl group.

The term "carboxacyl" as used throughout the specification and claims means the acyl radical of a hydrocarbon carboxylic acid or of a hydrocarbon carboxylic acid substituted with an inert group. Preferred as carboxacyl groups are the acyl radicals of hydrocarbon carboxylic acids and inert group substituted hydrocarbon carboxylic acids having from 2 to about 18 carbon atoms, inclusive, in their structure. Representative of such carboxacyl groups are those of formula:

$$E-\overset{\overset{\displaystyle O}{\|}}{C}-$$

wherein E is hydrocarbyl of from 1 to about 17 carbon atoms, inclusive, or hydrocarbyl of from 1 to about 17 carbon atoms, inclusive, wherein a hydrogen atom has been replaced with an inert substituent group. Illustrative of acyl radicals of a hydrocarbon carboxylic acid wherein E is hydrocarbyl are the acyl radicals of (a) saturated or unsaturated, straight or branched chain aliphatic carboxylic acids, for example, acetic, propionic, butyric, isobutyric, tert-butylacetic, valeric, isovaleric, caproic caprylic, decanoic, dodecanoic, lauric, tridecanoic, myristic, pentadecanoic, palmitic, margaric stearic, acrylic, crotonic, undecylenic, oleic, hexynoic, heptynoic, octynoic acids and the like; (b) saturated or unsaturated, alicylic carboxylic acids, for example, cyclobutanecarboxylic acid, cyclopentanecarboxylic acid, cyclopentenecarboxylic acid, methylcyclopentenecarboxylic acid, cyclohexanecarboxylic acid, dimethylcyclohexenecarboxylic acid, dipropylcyclohexanecarboxylic acid, and the like; (c) saturated or unsaturated, alicylic aliphatic carboxylic acids, for example, cyclopentaneacetic acid, cyclopentanepropionic acid, cyclohexanebutyric acid, methylcyclohexaneacetic acid, and the like; (d) aromatic carboxylic acids, for example, benzoic acid, toluic acid, naphthoic acid, ethylbenzoic acid, isobutylbenzoic acid, methylbutylbenzoic acid, and the like; and (e) aromatic-aliphatic carboxylic acids, for example, phenylacetic acid, phenylpropionic acid, phenylvaleric acid, cinnamic acid, phenylpropionic acid, and naphthylacetic acid and the like.

The term "hydrocarbon carboxylic acid substituted with an inert group" is used herein to mean a hydrocarbon carboxylic acid wherein one or more hydrogen atoms attached directly to a carbon atom have been replaced with a group inert to reaction under the conditions hereinafter described for using compounds (I) of the invention. Illustrative of such substituent groups are halo-, nitro-, hydroxy-, amino-, cyano-, thiocyano-, or alkoxy groups. Illustrative of halo-, nitro-, hydroxy-, amino-, cyano-, thiocyano- and alkoxy substituted hydrocarbon carboxylic acids are mono-, di- and trichloroacetic acid; $\alpha$- and $\beta$-chloropropionic acid; $\alpha$- and $\gamma$-bromobutyric acid; $\alpha$- and $\delta$ iodovaleric acid; mevalonic acid; 2- and 4-chlorocyclohexanecarboxylic acid; shikimic acid; 2-nitro-1-methylcyclobutanecarboxylic acid; 1,2,3,4,5,6-hexachlorocyclohexanecarboxylic acid; 3-bromo-2-methylcyclohexanecarboxylic acid; 4- and 5-bromo-2-methylcyclohexanecarboxylic acid; 5- and 6-bromo-2-methylcyclohexanecarboxylic acid; 2,3-dibromo-2-methylcyclohexanecarboxylic acid; 2,5-dibromo-2-methylcyclohexanecarboxylic acid; 4,5-dibromo-2-methylcyclohexanecarboxylic acid; 5,6-dibromo-2-methylcyclohexanecarboxylic acid; 3-bromo-3-methylcyclohexanecarboxylic acid; 6-bromo-3-methylcyclohexanecarboxylic acid; 1,6-dibromo-3-methylcyclohexanecarboxylic acid; 2-bromo-4-methylcyclohexanecarboxylic acid; 1,2-dibromo-4-methylcyclohexanecarboxylic acid; 3-bromo-2,2,3-trimethylcyclopentanecarboxylic acid; 1-bromo-3,5-dimethylcyclohexanecarboxylic acid; homogentisic acid; o-, m-, and p-chlorobenzoic acid; anisic acid; salicyclic acid; p-hydroxybenzoic acid; $\beta$-resorcyclic acid; gallic acid; veratic acid; trimethoxybenzoic acid; trimethoxycinnamic acid; 4,4'-dichlorobenzilic acid; o-, m-, and p-nitrobenzoic acid; cyanoacetic acid; 3,4- and 3,5-dinitrobenzoic acids; 2,4,6-trinitrobenzoic acid; thiocyanoacetic acid; cyanopropionic acid; lactic acid; ethoxyformic acid (ethyl hydrogen carbonate); butyloxyformic acid; pentyloxyformic acid; hexyloxyformic acid; dodecyloxyformic acid; hexadecyloxyformic acid and the like.

The term "cycloalkylamino" is used to mean an amino group wherein one or more hydrogen atoms have been replaced with a cycloalkyl group as defined above.

The term "alkylcycloalkylamino" means an amino group wherein one hydrogen atom has been replaced by an alkyl group and one has been replaced with a cycloalkyl group as defined above.

The term "halogen" is used herein in its conventional sense as embracive of chlorine, bromine, fluorine and iodine and the term "halo" means chloro, bromo, fluoro and iodo respectively.

The term "halophenoxy" means phenoxy wherein a hydrogen atom has been replaced with a halo group as defined above.

The term "alkylthio" means the monovalent moiety of formula:

$$\text{alkyl}-S-$$

wherein alkyl is as defined above. Representative of alkylthio are methylthio, pentylthio, dodecylthio and the like.

The term "arylthio" is used herein to mean the monovalent moiety of formula:

$$\text{aryl}-S-$$

wherein aryl is as defined above. Illustrative of arylthio are phenthio, naphththio and the like.

The compounds of formula (I) as given above are diazonium salts characterized by relative thermal stability and non-flammability.

The compounds (I) are useful as the active light-sensitive diazo ingredient in diazotype light-sensitizing compositions. The compounds of formula (I) are less flammable and thermally more stable than diazonium compounds having for example the formula:

$$ArN_2X \qquad \text{(II)}$$

wherein Ar has the same meaning as given above to it and X is an anion which forms a soluble salt with $ArN_2$ such as $Cl-$, $SO_4=$, $ZnCl_4=$, $SnCl_6=$, $CdCl_4=$, $BF_4-$ and the like.

The invention also comprises the method of making and using the compounds (I) in diazotype reproduction materials of the invention.

DETAILED DESCRIPTION OF THE PREFERRED EMBODIMENTS OF THE INVENTION

The compounds of the invention within the scope of the formula (I) given above may be prepared by reacting a diazonium compound of the formula (II) given above with a compound of the general formula:

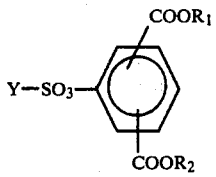

(III)

wherein $R_1$ and $R_2$ are as defined previously and wherein Y represents hydrogen or a metal ion which forms a soluble sulfonate salt, such as lithium, sodium, potassium, ammonium and like ions. The reaction may be illustrated by the schematic formula:

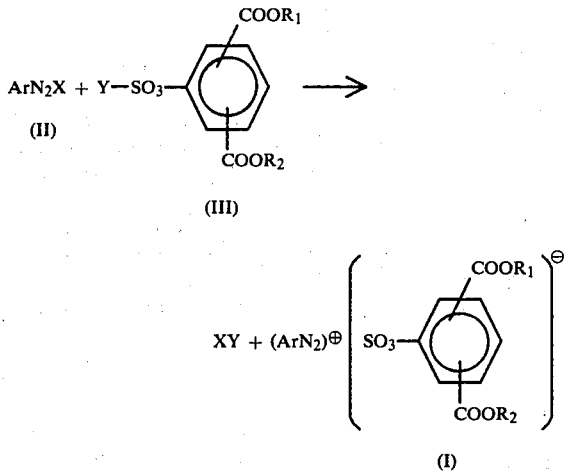

wherein Ar, $R_1$, $R_2$, X and Y have the meanings previously ascribed to them. The equation represents a double decomposition reaction and may be carried out in aqueous media. It is preferred to first dissolve the diazo salt (II) in the reaction media. The substituted phenyl sulfo salt or acid (III) is then introduced into the reaction mixture, preferably with stirring. The proportions of the reactants (II) and (III) employed in the reaction may be stoichiometric, i.e.; equimolar proportions may be used. Advantageously however a slight molar excess of the substituted phenyl sulfo salt or acid of formula (III) beyond that required for complete reaction with the diazo of formula (II) is used in the reaction.

The above described reaction to obtain the compounds (I) of the invention may be carried out over a broad range of temperatures and pressures, neither being a critical parameter of the reaction. Advantageously the reaction is carried out at a temperature within the range of from about −10° C. to about 50° C., preferably at room temperature (circa 26° C.) and under atmospheric pressures.

The reaction is generally complete within minutes and is indicated by precipitation of the desired product compounds of the formula (I) given above, in the reaction mixture. Precipitation usually occurs without further treatment of the solution, although under certain conditions, it may be desirable to initiate precipitation of the product diazo salt (I) by cooling the reaction mixtures, seeding the solution or adding some sodium chloride or like salt to reduce the solubility of the diazonium salt (I) in the reaction mixture. Following precipitation, the desired diazonium salts of the formula (I) are readily separated from the reaction mixture by conventional technique such as by filtering, washing and recrystallization.

A preferred method of preparation of the novel diazonium compounds (I) consists of reacting the substituted phenyl sulfo salt of formula (III) with the diazonium salt (II) in an aqueous media in the presence of a strong mineral acid like sulfuric acid. Crystallization, under such conditions, of the product diazonium salt of formula (I) takes place speedily, especially if the solution is cooled and some sodium chloride, sodium sulfate or the like is added. It has been found that in the presence of a strong acid, the substituted phenyl sulfo group imparts a property of lower water solubility to the diazonium (I). This is important because it facilitates the economical manufacture of a wide variety of stabilized diazo salts (I) by the double decomposition reaction described herein. The proportion of strong mineral acid present in the preferred method of preparing the diazonium salts (I) of the invention is a water-insolubilizing proportion. In general, a water-insolubilizing proportion is the amount necessary to establish a pH below 5 in the reaction media.

Those skilled in the art will appreciate that the above-described methods of preparing the novel diazonium salt compounds of the formula (I) do not include the use of zinc or zinc compounds. The dispensability of zinc in the reaction media is of importance to diazonium compound manufacturers in relation to environmental problems associated with the disposal of waste solutions (as is the case in conventional processes when diazonium zinc chloride salts are prepared).

It will also be appreciated that in the above-described method, when X represents halogen, that it is not necessary to isolate the diazonium halide (II) as a double salt such as a sulfate, a chlorozincate, or a borofluoride in order to make the diazonium salt (I). The diazonium halide (II) solution is sufficient as a reaction media.

The diazonium compounds of the formula (II) employed as reactants in the synthesis of the compounds (I) of the invention are generally well-known compounds as is the method of their preparation. Representative of such compounds of the formula (II) are 1-diazo-4-N,N-dimethylaminobenzene chloride,
1-diazo-4-N,N-diethylaminobenzene chloride,
1-diazo-4-N-morpholinobenzene chloride,
1-diazo-4-N-piperidinobenzene chloride,
1-diazo-4-N-piperazinobenzene chloride,
1-diazo-4-N-pyrrolidinobenzene chloride,
1-diazo-4-N-pyrrolidino-3-methylbenzene chloride,
1-diazo-4-N-pyrrolidino-3-methoxybenzene chloride,
1-diazo-4-N-morpholino-2,5-diethoxybenzene chloride,
1-diazo-4-N-morpholino-2,5-dimethoxybenzene chloride,
1-diazo-4-N-morpholino-2,5-dipropoxybenzene chloride,
1-diazo-4-N-morpholino-2,5-dibutoxybenzene chloride,
1-diazo-4-p-tolylmercapto-2,5-diethoxybenzene chloride,
1-diazo-4-p-tolylmercapto-2,5-dimethoxybenzene chloride,
1-diazo-4-p-ethoxyphenyl-2,5-diethoxybenzene chloride,
1-diazo-4-p-chlorophenoxy-2,5-diethoxybenzene chloride,
1-diazo-4-N-N-diethylamino-3-chlorobenzene chloride,
1-diazo-4-N-N-diethylamino-2-ethoxybenzene chloride,
1-diazo-4-N-N-diethylamino-2-chloro-5-p chlorophenoxybenzene chloride, 1-diazo-4-N-methyl-N-cyclohexyl-3-chlorobenzene chloride,
1-diazo-4-N-N dibutyl-3-chlorobenzene chloride,
1-diazo-4-N-methyl-N-benzyl-3-ethoxybenzene chloride,
and the like.

Other diazonium compounds of the formula (II) are identified in the U.S. Pat. No. 4,055,425 (columns 5 and 6) and in Van der Grinten, Photographic Journal, Vol. 92B, (1952), page 46. Methods of synthesis for the compounds of formula (II) are given in chemical manuals such as Azo and Diazo Chemistry, by H. Zollinger, Interscience, New York, 1961 and The Aromatic Diazo Compounds, K. H. Saunders, E. Arnold and Co., London, (1969).

The reactant compounds of formula (III) are also well-known compounds as is the method of their preparation. Representative of the compounds of the formula (III) are
3-sulfobenzoic acid,
3-sulfobenzoic acid, sodium salt,
3,5-disulfobenzoic acid,
3,5-disulfobenzoic acid, potassium salt,
4-sulfophthalic acid,
4-sulfophthalic acid, ammonium salt,
5-sulfoisophthalic acid,
5-sulfoisophthalic acid, sodium salt,
5-dimethylsulfoisophthalic acid, sodium salt
and the like. Preferred compounds (III) are 5-sulfoisophthalic acid sodium salt and 5-dimethylsulfoisophthalic acid sodium salt. They are preferred because of the exceptionally easy recovery of the diazonium salt derivatives thereof of the formula (I).

When gradually heated, all diazonium salts decompose, first with evolution of nitrogen and then with formation of pyrolitic products of the decomposition. Some diazonium salts decompose by a self propagating reaction once decomposition is initiated. In such cases a small local decomposition of any given amount will lead to the decomposition of the entire amount. Most diazo chlorozincate salts have a high rate of self propagating decomposition which places them in a high hazard category.

The diazonium salt compounds (I) of the invention, in contrast to prior art diazonium salts, do not propagate decomposition after a decomposition occurs in a localized portion of a given batch of the compound (initiated for example by excessive thermal exposure). It is not really well understood why the diazo compounds of this invention do not propagate an initiated decomposition and do not sustain a flame when ignited, but it is assumed that under the action of heat, not only is nitrogen evolved but the carboxylic group or groups are also broken and evolution of carbon dioxide takes place with its well-known fire extinguishing effect.

The diazonium salt compounds (I) of the invention are useful as active ingredients in light-sensitive diazotype reproduction materials, generally employed as coatings of light-sensitive diazonium compositions on base support materials.

The diazotype reproduction materials of the invention may be prepared by coating aqueous mixtures of the diazo compositions of the invention on a suitable base support material, using conventional diazo coating apparatus. The techniques are well-known; see for example U.S. Pat. Nos. 3,923,518 and 3,996,056. Representative of suitable base supports are thermoplastic polymeric resin films, foils including metal foils, cloth, opaque paper, translucent papers and like supports. Preferred are the commercially available diazotype papers.

It has also been found that although the diazonium salts (I) of the invention have a low water solubility in a strong mineral acid media, they have a much higher solubility in a weak acid media, in the presence of a variety of couplers and salts such as ammonium tartrate, ammonium citrate, mono sodium glutamate, ammonium formate, potassium citrate, sodium acetate and the like. The reason for the solubilizing effect of these compounds is not well understood, but it greatly facilitates the utilization of the diazonium salts (I) in the preparation of aqueous coated diazotype materials as will be appreciated by those skilled in the art.

Surprisingly it has also been found that the diazonium salts (I) of the invention are also soluble in organic solvents. Since polymeric resin films and plastic coated base materials are usually coated with non-aqueous sensitizing solutions as distinguished from aqueous solutions, the diazonium salts (I) may be readily coated on such base supports. There is an advantage to such a use of the diazonium compounds (I). Special diazo salts have been suggested previously for use in organic solvent sensitizing. For instance, diazo hexafluorophosphates, diazo hexafluoroarsenates and diazo hexafluoroantimonates are readily soluble in organic solvents. However, such diazos suffer from inherent disadvantages. The hexafluoroarsenates and antimonate salts of diazos are too toxic to have found any commercial application, and the hexafluorophosphates are so insoluble in water as to not tolerate the slightest amount of water in their formulations. This increases the cost of solvents used, which must be totally free of even traces of water. In addition, many sensitizing systems for polymeric film coatings are based on mixtures of solvents and water to reduce cost and fire hazard. Since the diazonium salts (I) are soluble both in water and in solvents, they are eminently suitable for use in the manufacture of polymeric film and plastic coated base support materials with commercial low cost solvents and/or water-solvent mixtures.

As is well-known in the art, diazo compositions for the two-component diazotype process comprise at least one light-sensitive diazonium compound, at least one azo coupler and acidic stabilizers which are necessary to obtain a diazotype copy. Further components for such diazo compositions may include, for example:

1. development accelerators such as glycerol, polypropylene glycol, urea and the like to minimize the necessary ammonia or amine concentration in the developing environment;

2. antioxidants such as thiourea, 1,3,6-naphthalene trisulfonic acid sodium salt and the like to stabilize diazotype prints against discoloration under daylight exposure;

3. contrast controlling compounds; and 4. solubilizers such as caffein which improve the compatibility of the various components in the sensitizing solution.

Sometimes such components fulfill more than one of these functions.

An acid stabilizer is generally a necessary ingredient of the diazo compositions of the invention. Any of the well-known acid stabilizers previously used in light-sensitive diazo coating compositions may be used. Representative of such acid stabilizers are citric acid, tartaric acid, boric acid, mixtures thereof and the like.

In preferred diazo compositions of the invention, azo couplers are mixed with the diazonium compounds (I) in an acid environment to prevent precoupling. When changing the pH from an acid to an alkaline pH, the coupling reaction occurs to produce an azo dye as is known in the art. Azo couplers are generally aromatic compounds with phenolic hydroxyl groups with or without other substituent groups. The couplers are generally colorless. Representative of azo couplers are:

1. resorcinol and its halogen and alkyl derivatives and ethers;
2. resorcyclic acids with or without halogen substitution in the ring and their amides and substituted amides;
3. dihydroxy naphthalene mono sulfonic acids and disulfonic acids;
4. dihydroxy naphthalenes;
5. beta and alpha-hydroxy naphthoic acid amides and substituted amides;
6. compounds with active methylene groups such as aceto-acet derivatives and cyano-acet derivatives;
7. mono and poly hydroxy biphenyls;
8. polyhydroxy biphenyl sulfides;
9. pyrazolone derivatives;
10. amino phenol derivatives; and the like.

The light-sensitive diazo coating compositions of the invention may contain any number of additional ingredients conventionally used in the preparation of prior art light-sensitive diazo coating compositions such as, for example, solubilizers, fillers, stabilizers, accelerators, solvents, anti-oxidants, contrast controlling compounds and the like.

The proportions of the various components of the diazo compositions of the invention may be those proportions conventionally used in their use prior to this invention, in the preparation of prior art diazo light-sensitive compositions (where they were so used). These proportions are well-known to those skilled in the art; see for example the disclosures of Kosar, supra., and the U.S. Pat. Nos. 3,923,518 and 3,996,056.

The diazo compositions of the invention may be prepared by bringing the ingredients together in a suitable reaction vessel. Preferably the compositions of the invention are prepared in an aqueous media for use as an aqueous coating mixture to prepare diazotype reproduction materials of the invention.

In one-component diazotype reproduction materials, the diazo composition layer contains the diazonium compound (I) and other auxiliary agents such as those mentioned above, but without the azo coupling component. A developing solution, alkaline or neutral, containing highly reactive coupling components such as phloroglucinol and resorcinol and buffer salts, such as sodum borate or sodium formate, is applied to the diazotype material after image exposure to effect development of the print.

The following examples describe the manner and method of making and using the invention and set forth the best mode contemplated by the inventors but are not to be construed as limiting. All parts specified are by weight unless otherwise stated. Tests carried out in the examples are as follows.

Flammability test: a small train of powdered diazonium compound, 1 centimeter wide, 10 centimeters long and ½ centimeter high is ignited at one end with a match. If the diazonium compound ignites and the flame propagates itself along the whole length of the diazonium compound train, the diazonium compound is considered flammable. If the diazonium compound does not ignite or if the local decomposition of the diazonium under the match does not propagate itself along part of the length of the diazonium compound train, the diazonium compound is considered non-flammable.

EXAMPLE 1

(A) An aqueous solution of 1-diazo-4-N,N-dimethylamino benzene chloride is cooled to 4° C. and mixed with a saturated solution of 5-sulfoisophthalic acid sodium salt. The amount of 5-sulfoisophthalic acid sodium salt is in slight excess (10% to 20%) of the stoichiometric amount required to react with the chloride (calculated on a 1:1 reaction between the reactants). A quantity of concentrated sulfuric acid equivalent to 0.1 mol per mol of diazonium salt is added. A saturated solution of sodium chloride is then added dropwise until precipitation of a diazonium salt is initiated.

The light yellow crystalline precipitate is filtered off and air dried to obtain 1-diazo-4-N,N-dimethylaminobenzene sulfoisophthalate. The thermal and flammability characteristics of the sulfoisophthalate are compared to those of the 1-diazo-4-N,N-dimethylamino chlorozincate and the corresponding borofluoride with the following results:

| | Decomposition Range | Flammability |
|---|---|---|
| 1-diazo-4-N,N—dimethylamino benzene sulfoisophthalate | 165° C.–170° C. | non-flammable |
| 1-diazo-4-N,N—dimethylamino benzene chlorozincate | 135° C.–140° C. | flammable |
| 1-diazo-4-N,N—dimethylamino benzene borofluoride | 135° C.–140° C. | flammable |

(B) A white base paper suitable for the diazotype process, which has been precoated with an aqueous silica dispersion and polyvinylacetate emulsion in a manner well-known in the art, is sensitized with a liquid containing:

| | |
|---|---|
| citric acid | 20 g |
| theophylline | 15 g |
| thiourea | 60 g |
| 2,7-dihydroxy 3,6 naphthalene disulfonic acid sodium salt | 10.5 g |
| trihydroxydiphenyl 50% solution | 8 g |
| 1-diazo-4-N,N—dimethylamino benzene sulfoisophthalate | 15 g |
| sodium chloride | 30 g |
| zinc chloride | 50 g |
| water | 1000 cc |

Printing of the sensitized paper under a transparent master bearing a black ink image and development with ammonia in a conventional manner gave a blackline copy of equal density, and brightness to the one obtained with the same sensitizing liquid in which 1-diazo-4-N,N-dimethylaminobenzene chlorozincate is used instead of the corresponding sulfoisophthalate salt.

EXAMPLE 2

(A) An aqueous solution of 1-diazo-4-N,N-diethylaminobenzene chloride is cooled with ice and reacted with a solution of 5-sulfoisophthalic acid, sodium salt containing 0.2 mol of concentrated hydrochloric acid per mol of diazonium salt, following the procedure of Example 1, supra., upon addition of the saturated solution of sodium chloride, the diazonium salt 1-diazo-4-N,N-diethylamino benzene sulfoisophthalate is precipitated and isolated by filtration. The product diazo was subjected to the same thermal and flammability tests as in Example 1 in comparison to the corresponding chlorozincate and borofluoride with the following results:

| | Decomposition Range | Flammability |
|---|---|---|
| 1-diazo-4-N,N—diethylamino-benzene chlorozincate | 136° C.-141° C. | flammable |
| 1-diazo-4-N,N-diethylamino benzene borofluoride | 122° C.-127° C. | flammable |
| 1-diazo-4-N,N—diethylamino benzene sulfoisophthalate | 162° C.-167° C. | non-flammable |

(B) A white base paper suitable for the diazotype process is precoated and then sensitized with a liquid containing:

| | |
|---|---|
| citric acid | 20 g |
| thiourea | 40 g |
| urea | 50 g |
| 2,3-dihydroxy 6, naphthalene sulfonic acid, sodium salt | 15 g |
| dipropylene glycol | 10 ml |
| 1-diazo-4-N,N—diethylamino-benzene sulfoisophthalate | 11 g |
| zinc chloride | 60 g |
| saponin | 0.25 g |
| water | 1000 ml |

Printing under a transparent master bearing a black ink image and development with ammonia in a conventional manner gave a blueline copy of equal density and brightness as one obtained with a similar sensitizing liquid in which 1-diazo-4-N,N-diethylaminobenzene chlorozincate salt is used instead of the corresponding sulfoisophthalate salt.

EXAMPLE 3

(A) Following the procedure of Example 1, supra., an aqueous solution of 1-diazo-4-p-tolylthio-2,5-diethoxybenzene chloride is reacted with a saturated solution of 5-sulfoisophthalic acid, sodium salt except that only a stoichiometric amount of reactants (calculated on a 1:1 reaction) is used. Under such conditions practically all of the product diazonium salt which is 1-diazo-4-p-tolylthio-2,5-diethoxybenzene sulfoisophthalate is precipitated and easily isolated. The sulfoisophthalate is compared to corresponding chlorozincate and borofluoride salts with the following results:

| | Decomposition Range | Flammability |
|---|---|---|
| 1-diazo-4-p-tolylmercapto-2,5-diethoxybenzene sulfo-isophthalate | 165° C.-170° C. | non-flammable |
| 1-diazo-4-p-tolylmercapto-2,5-diethoxybenzene chlorozincate | 141° C.-146° C. | non-flammable |
| 1-diazo-4-p-tolylmercapto-2,5-diethoxybenzene boro-fluoride | 145° C.-150° C. | non-flammable |

(B) A white base paper suitable for the diazotype process, which has been precoated with an aqueous silica dispersion and sodium caseinate solution in a manner well-known in the art, is sensitized with a liquid containing:

| | |
|---|---|
| citric acid | 5 g |
| caffeine | 10 g |
| potassium citrate | 5 g |
| 1,3,6-1,3,7-naphthalene trisulfonic acid, sodium salt | 60 g |
| 1-diazo-4-p-tolylthio-2,5-diethoxybenzene sulfoisophthalate | 10 g |

The sensitized paper is printed under a transparent master being a black ink image and developed as a one-component diazotype material in a conventional manner with the following liquid developer:

| | |
|---|---|
| sodium formate | 45 g |
| sodium tartrate | 2 g |
| sodium benzoate | 15 g |
| phloroglucinol | 3.5 g |
| isopropyl naphthalene sulfonic acid, sodium salt | 0.5 g |
| Water | 1000 ml |

The blackline copy obtained is of equal density and brightness as the one obtained with a sensitizing liquid containing 1-diazo-4-p-tolylthio-2,5-diethoxybenzene chlorozincate instead of the sulfoisophthalate salt.

EXAMPLE 4

(A) An aqueous solution of 1-diazo-4-N-pyrrolidino-3-methylbenzene chlorozincate is cooled with ice and mixed with a 30% aqueous solution of 5-sulfoisophthalic acid sodium salt in slight excess (10% to 20%) of the stoichiometric amount calculated to react with all the diazo in a 1:1 reaction. Upon addition of a saturated solution of sodium sulfate, the diazonium salt 1-diazo-4-N-pyrrolidono-3-methylbenzene sulfoisophthalate is precipitated.

The product was subjected comparatively to the same thermal and flammability tests as in Example 1 with the following results:

| | Decomposition Range | Flammability |
|---|---|---|
| 1-diazo-4-N—pyrrolidino-3-methylbenzene chlorozincate | 120° C.-125° C. | flammable |
| 1-diazo-4-N—pyrrolidino-3-methylbenzene borofluoride | 110° C.-115° C. | flammable |
| 1-diazo-4-N—pyrrolidino-3-methylbenzene sulfoisophthalate | 135° C.-140° C. | non-flammable |

(B) A white 65 g/m$^2$ transparentized rag base paper which has been precoated with an aqueous silica dispersion and polyvinylacetate multipolymer emulsion in a manner well-known in the art, is sensitized with a liquid containing:

| | |
|---|---|
| p-toluene sulfonic acid | 15 g |
| sulfosalicylic acid | 3.5 g |
| ammonium citrate | 20 g |
| thiourea | 40 g |
| beta resorcylic acid ethanolamide | 17 g |
| 2,5 dimethyl morpholino methyl phenol | 25 g |
| alpha-resorcylic acid | 2.5 g |

-continued

| | |
|---|---|
| 1-diazo-4-N—pyrrolidino-3-methyl-benzene sulfoisophthalate | 50 g |
| zinc chloride | 20 g |
| 1,3,6-1,3,7-naphthalene trisulfonic acid, sodium salt | 40 g |
| micronised silica | 20 g |
| polyvinylacetate emulsion | 25 ml |
| saponin | 0.25 g |
| water | 1000 ml |

Printing under a transparent master and development with ammonia in a conventional manner gave a sepia line copy of the original master. In view of the actinic opacity of the sepia image, such a copy is eminently suitable for further reproduction on standard diazotype materials. This copy was as good as one obtained with the corresponding chlorozincate salt replacing the 1-diazo-4-N-pyrrolidino-3-methylbenzene sulfoisophthalate.

EXAMPLE 5

(A) Following the procedure of Example 1, supra., the compounds 1-diazo-4-morpholino-2,5-diethoxybenzene chloride and 5-dimethylsulfoisophthalic acid sodium salt are reacted together to give 1-diazo-4-morpholino-2,5-diethoxybenzene 5-dimethyl sulfoisophthalate. The procedure is repeated again, but replacing the 5-dimethylsulfoisophthalic acid sodium salt as used above with 5-sulfoisophthalic acid sodium salt to obtain 1-diazo-4-morpholino-2,5-diethoxybenzene sulfoisophthalate. The thermal and flammability tests show the following results:

| | Decomposition Range |
|---|---|
| 1-diazo-4-morpholino-2,5-diethoxybenzene chlorozincate | 115° C.-120° C. |
| 1-diazo-4-morpholino-2,5-diethoxybenzene chlorozincate diluted with 40% citric acid | 118° C.-123° C. |
| 1-diazo-4-morpholino-2,5-diethoxybenzene borofluoride | 120° C.-125° C. |
| 1-diazo-4-morpholino-2,5-diethoxybenzene 5-dimethylsulfoisophthalate | 160° C.-165° C. |
| 1-diazo-4-morpholino-2,5-diethoxybenzene 5-sulfoisophthalate | 144° C.-149° C. |

Of the above salts, the chlorozincate, the chlorozincate diluted with 40% citric acid, and the borofluoride were found to be flammable, the 5-dimethylsulfoisophthalate and the 5-sulfoisophthalate were fround to be non-flammable.

(B) A polyethylene terephthalate film which has been surface treated for adhesion promotion, such as Melinex 505 (ICI Americas Inc.) is coated with a layer of cellulose acetate propionate in a manner well-known in the art, and is subsequently sensitized with the following liquid:

| | |
|---|---|
| methanol | 400 ml |
| ethylene glycol monomethyl ether | 400 ml |
| methyl ethyl ketone | 100 ml |
| formic acid | 50 ml |
| sulfosalicylic acid | 15 g |
| thiourea | 10 g |
| beta-resorcylic acid ethanolamide | 10 g |
| 3-hydroxyphenyl urea | 20 g |
| 1-diazo-4-N—morpholino-2,5-diethoxy benzene-5-dimethylsulfoisophthalate | 25 g |

The sensitized film thus obtained was exposed through a transparent master and developed with ammonia in a conventional manner to give a deep sepia color image of the original master. The copy film was eminently suitable for further reproduction on diazotype materials and was as good as one obtained with the corresponding diazo borofluoride salt replacing the 1-diazo--4-N-morpholino-2,5-diethoxybenzene 5-dimethylsulfoisophthalate.

EXAMPLE 6

(A) Following the procedure of Part (A) Example 3, supra., the compound 1-diazo-4-morpholino-2,5-dibutoxybenzene-5-sulfoiosphthalate is made by replacing the 1-diazo-4-p-tolylmercapto-2,5-diethoxybenzene chloride as used in the Example 3 with an equal proportion of 1-diazo-4-morpholino-2,5-dibutoxybenzene chloride.

The thermal and flammability tests show the following results:

| | Decomposition Range |
|---|---|
| 1-diazo-4-morpholino-2,5-dibutoxybenzene chlorozincate | 135° C.-140° C. |
| 1-diazo-4-morpholino-2,5-dibutoxybenzene sulfate | 110° C.-115° C. |
| 1-diazo-4-morpholino-2,5-dibutoxybenzene borofluoride | 125° C.-130° C. |
| 1-diazo-4-morpholino-2,5-dibutoxybenzene-5-sulfoisophthalate | 135° C.-140° C. |

Of the above salts the chlorozincate salt was found to be flammable, the sulfate salt and the borofluoride were found to be slightly flammable, the 5-sulfoisophthalate salt was found to be non-flammable.

(B) A white base paper suitable for the diazotype process is sensitized with a liquid containing:

| | |
|---|---|
| citric acid | 7.5 g |
| caffeine | 3 g |
| urea | 25 g |
| thiourea | 10 g |
| dipropylene glycol | 10 g |
| 1,3,6-1,3,7 naphthalene trisulfonic acid sodium salt | 70 g |
| 4-bromo-α-resorcylic acid amide | 6 g |
| ammonium citrate | 30 g |
| 1-diazo-4-morpholino-2,5-dibutoxybenzene 5-sulfoisophthalate | 11 g |
| zinc chloride | 25 g |
| amorphous silica | 50 g |
| polyvinyl acetate emulsion | 50 ml |
| saponin | 0.5 g |
| water | 1000 ml |

Printing under a transparent original and development with ammonia in a conventional manner gave a redline copy of equal density and brightness to the one obtained with the same sensitizing liquid in which the sulfate salt of 1-diazo-4-morpholino-2,5-diethoxybenzene instead of the corresponding sulfoisophthalate salt is used.

EXAMPLE 7

(A) Following the procedure of Example 1, supra., an aqueous solution of 1-diazo-4-N-methyl-N-cyclohexylamino-3-chlorobenzene chloride is cooled with ice and mixed with a solution of 5-sulfoisophthalic acid, sodium salt and methane sulfonic acid in an amount equivalent to 0.5 mol per mol of diazonium salt, to precipitate 1-diazo-4-N-methyl-N-cyclohexylamine-3-chlorobenzene sulfoisophthalate.

The thermal and flammability tests show the following results in comparison to the corresponding chlorozincate and borofluoride salts.

| | Decomposition Range |
|---|---|
| 1-diazo-4-N—methyl-N—cyclohexylamino-3-chlorobenzenechlorozincate | 128° C.-133° C. |
| 1-diazo-4-N—methyl-N—cyclohexylamino-3-chlorobenzene borofluoride | 110° C.-115° C. |
| 1-diazo-4-N—methyl-N—cyclohexylamino-3-chlorobenzene sulfoisophthalate | 150° C.-155° C. |

The above chlorozincate salt was found to be flammable; the borofluoride and the sulfoisophthalate salts were found to be non-flammable.

(B) A blue tinted 65 g/m$^2$ transparentized rag base paper was precoated with an aqueous silica dispersion of polyvinyl acetate emulsion in a manner well-known in the art, and subsequently sensitized with a liquid containing:

| | |
|---|---|
| citric acid | 5 g |
| 1,3,6-1,3,7 naphthalene trisulfonic acid, sodium salt | 60 g |
| ammonium citrate | 30 g |
| 1-diazo-4-N—methyl-N—cyclohexylamino-3-chlorobenzene sulfoisophthalate | 35 g |
| water | 1000 ml |

The sensitized paper was printed under a transparent master and developed as a one-component diazotype material in a conventional manner with the following liquid developer.

| | |
|---|---|
| potassium borate tetrahydrate | 35 g |
| potassium citrate | 15 g |
| tripotassium phosphate | 5 g |
| sodium hyposulfite | 2.5 g |
| boric acid | 2 g |
| phloroglucinol | 4.8 g |
| resorcinol | 2 g |
| isopropylnaphthalene sulfonic acid, sodium salt | 0.5 g |
| water | 1000 ml |

A sepia line copy of the original master is obtained and in view of the actinic opacity of the sepia image the copy is eminently suitable for further reproduction on diazotype materials. This copy is as good as one obtained with the corresponding diazo chlorozincate salt replacing the diazonium sulfoisophthalate salt.

EXAMPLE 8

(A) An aqueous solution of 1-diazo-4-N-morpholino-2,5-dibutoxybenzene sulfate is cooled with ice and mixed with a saturated solution of 4-sulfophthalic acid in slight excess of the stoichiometric amount calculated to react with all of the diazo in a 1:1 reaction. Upon addition of sodium chloride crystals and seeding, 1-diazo-4-N-morpholino-2,5-dibutoxybenzene sulfophthalate is precipitated. Upon separation of the product precipitate, the decomposition temperature range of this salt is found to be 137° C.-142° C. and the salt is non-flammable.

(B) An 80 g/m$^2$ translucent natural tracing paper is coated according to conventional methods with a cellulose acetate butyrate layer and subsequently sensitized with the following liquid:

| | |
|---|---|
| ethyl alcohol | 500 ml |
| ethylene glycol mono ethyl ether | 500 ml |
| p-toluene sulfonic acid | 10 g |
| sulfosalicylic acid | 10 g |
| thiourea | 15 g |
| resorcinol monohydroxyethyl ether | 15 g |
| beta-resorcilic acid, ethanolamide | 10 g |
| 1-diazo-4-N—morpholino-2,5-dibutoxybenzene-4-sulfophthalate | 25 g |

The sensitized tracing paper thus obtained was exposed through a transparent original with ink lines and developed with ammonia in a conventional manner to give a deep sepia color copy of the original. This copy is eminently suitable for further reproduction on diazotype materials and is as good as one obtained with the corresponding diazo borofluoride salt replacing the 1-diazo-4-N-morpholino-2,5-dibutoxybenzene-4-sulfophthalate.

What is claimed:

1. A light-sensitive diazonium salt of the formula:

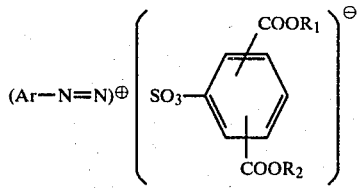

wherein Ar represents aryl or substituted aryl; $R_1$ and $R_2$ are each selected from the group consisting of hydrogen and alkyl.

2. The salt of claim 1 wherein Ar represents an aryl group substituted in the position para to the diazonium group by a chemical group selected from amino, alkylamino, dialkylamino, alkylhydroxyalkylamino, dihydroxyalkylamino, alkoxy, phenoxy, cycloalkylamino, alkylcycloalkylamino, alkylarylamino, alkylaralkylamino, diarylamino, tolylthio, morpholino, pyrrolidino, piperidino and piperizino.

3. The salt of claim 2 wherein the positions on the Ar group ortho and meta to the diazonium group are unsubstituted or substituted by a chemical group selected from alkyl, alkoxy, phenoxy, halophenoxy, halogen and those of the formula $A_c$—NH— wherein $A_c$ represents carboxacyl.

4. The salt of claim 1 which is 1-diazo-4-N,N-dimethylaminobenzene sulfoisophthalate.

5. The salt of claim 1 which is 1-diazo-4-N,N-diethylaminobenzene sulfoisophthalate.

6. The salt of claim 1 which is 1-diazo-4-p-tolylthio-2,5-diethoxybenzene sulfoisophthalate.

7. The salt of claim 1 which is 1-diazo-4-N-pyrrolidino-3-methylbenzene sulfoisophthalate.

8. The salt of claim 1 which is 1-diazo-4-morpholino-2,5-diethoxybenzene-5-dimethylsulfoisophthalate.

9. The salt of claim 1 which is 1-diazo-4-morpholino-2,5-diethoxybenzene-5-sulfoisophthalate.

10. The salt of claim 1 which is 1-diazo-4-morpholino-2,5-dibutoxybenzene-5-sulfoisophthalate.

11. The salt of claim 1 which is 1-diazo-4-N-methyl-N-cyclohexylamino-3-chlorobenzene sulfoisophthalate.

12. The salt of claim 1 which is 1-diazo-4-N-morpholino-2,5-dibutoxybenzene-4-sulfophthalate.

13. A light-sensitive diazo coating composition, which comprises;

a diazonium compound of the formula:

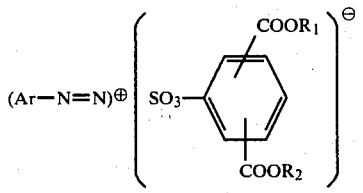

wherein Ar represents aryl or substituted aryl; $R_1$ and $R_2$ are each selected from the group consisting of hydrogen and alkyl; and and acid stabilizer.

14. The composition of claim 13 which additionally comprises an azo coupler.

15. The composition of claim 14 which additionally comprises a solubilizing proportion of a compound selected from the group consisting of ammonium tartrate, ammonium citrate, mono sodium glutamate, ammonium formate, potassium citrate and sodium acetate.

16. A light-sensitive diazotype reproduction material, which comprises; a base support, and a coating on the support, which comprises in admixture a diazonium compound of the formula:

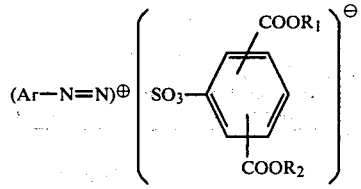

wherein Ar represents aryl or substituted aryl; $R_1$ and $R_2$ are each selected from the group consisting of hydrogen and alkyl;

an acid stabilizer; and an azo coupler.

* * * * *